US007395006B2

(12) United States Patent
Ozawa

(10) Patent No.: US 7,395,006 B2
(45) Date of Patent: Jul. 1, 2008

(54) FRAME FOR IMAGE FORMATION DEVICE

(75) Inventor: Toru Ozawa, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 150 days.

(21) Appl. No.: 11/283,753

(22) Filed: Nov. 22, 2005

(65) Prior Publication Data

US 2006/0285875 A1 Dec. 21, 2006

(30) Foreign Application Priority Data

Jun. 20, 2005 (JP) ..... 2005-179654

(51) Int. Cl.
*G03G 15/00* (2006.01)

(52) U.S. Cl. ..... 399/107; 399/110

(58) Field of Classification Search ..... 399/107, 399/110, 125; 347/138, 152
See application file for complete search history.

(56) References Cited

U.S. PATENT DOCUMENTS 4,785,319 A * 11/1988 Fujino et al. ..... 347/138
5,844,687 A * 12/1998 Nagane et al. ..... 399/107 X
6,259,872 B1 * 7/2001 Fukunaga et al. ..... 399/107
6,393,234 B1 * 5/2002 Tashiro ..... 399/107
2004/0247338 A1 * 12/2004 Makino ..... 399/107
2004/0264999 A1 * 12/2004 Marumoto ..... 399/107

FOREIGN PATENT DOCUMENTS

| | | | |
|---|---|---|---|
| JP | 2002-185154 | A | 6/2002 |
| KR | 1998-0037685 | A | 8/1998 |
| KR | 2001-0045775 | A | 6/2001 |
| KR | 2003-0063132 | A | 7/2003 |
| KR | 10-2004-0047926 | A | 6/2004 |

* cited by examiner

*Primary Examiner*—Sophia S Chen
(74) *Attorney, Agent, or Firm*—Sughrue Mion, PLLC

(57) ABSTRACT

An image formation device at which a pair of first side plates and a pair of second side plates are provided. Process cartridges are installed between the first side plates. Other apparatus to be disposed in a main body of the device is installed between the second side plates, which are disposed with a narrower spacing therebetween than the first side plates. In addition, electrical components are disposed at outer sides of the second side plates.

20 Claims, 4 Drawing Sheets

FRAME FOR IMAGE FORMATION DEVICE

CROSS-REFERENCE TO RELATED APPLICATION

This application claims priority under 35 USC 119 from Japanese Patent Application No. 2005-179654, the disclosure of which is incorporated by reference herein.

BACKGROUND OF THE INVENTION

1. Field of the Invention

The present invention relates to an image formation device for forming an image on a recording medium.

2. Description of the Related Art

An image formation device for forming an image on a recording medium has been disclosed (for example, Japanese Patent Application Laid-Open (JP-A) No. 2002-185154) in which an electrical unit is vertically arranged at an outer side of a side plate of a casing frame, in addition to which an outer side of the electrical unit is covered by a casing.

However, when an electrical unit is disposed at an outer side of a side plate of a casing frame, overall width of the device becomes larger by an amount corresponding to a width of the electrical unit, which impedes efforts to reduce size of the device.

Meanwhile, for a multi-color image formation device that is provided with process cartridges arranged in tandem and a transfer belt arranged in a lateral direction relative to the process cartridges, a structure has been disclosed (for example, JP-A No. 2003-208024) in which an exposure unit and the process cartridges are installed between a pair of side plates.

However, at an image formation device as described in JP-A No. 2003-208024, if electrical components such as a driving motor, a circuit board and the like are disposed at inner sides of the side plates, it becomes less possible to assure sufficient space for the exposure unit, the process cartridges and the like. Further, if electrical components such as the driving motor, the circuit board and the like are disposed at an outer side of the side plates, width of the device as a whole becomes larger, which impedes efforts to reduce size of the device.

SUMMARY OF THE INVENTION

In consideration of the circumstances described above, the present invention will reduce overall width of a device and facilitate a reduction in size of the device.

A first aspect of the present invention provides an image formation device including: a pair of first side plates provided at a device main body, between which a process cartridge is installed; a pair of second side plates, between which another apparatus to be disposed at the device main body is installed, the second side plates being disposed with a narrower spacing therebetween than the first side plates; and an electrical component, which is disposed at an outer side of the second side plates.

A second aspect of the present invention provides an image formation device including: a frame, which is integrally provided With a pair of first side plates provided at a device main body, between which a process cartridge is installed, and a pair of second side plates, between which another apparatus to be disposed at the device main body is installed, the second side plates being disposed with a narrower spacing therebetween than the first side plates; and an electrical component, which is disposed at an outer side of the second side plates; wherein the first side plates and second side plates are joined by inflected joining portions, and the frame is structured in the form of a substantial letter 'U' shape, and the electrical component is disposed such that at least a portion thereof falls within a projected area of the process cartridge.

A third aspect of the present invention provides an image formation device including: a pair of first side plates provided at a device main body, between which a processing section which includes at least a photosensitive body is installed; a pair of second side plates, between which another apparatus to be disposed at the device main body is installed, the second side plates being disposed with a narrower spacing therebetween than the first side plates; and an electrical component, which is disposed at an outer side of the second side plates.

Other aspects, features and advantages of the present invention will become apparent from the following descriptions, which are given with regard to the accompanying drawings.

BRIEF DESCRIPTION OF THE DRAWINGS

Preferred embodiments of the invention will be described in detail based on the following figures, in which.

DETAILED DESCRIPTION OF THE INVENTION

An example of an embodiment relating to an image formation device of the present invention will be described below with reference with the drawings.

First, overall structure of an image formation device 10 of the present embodiment will be described on the basis of FIG. 1.

Figure 1:
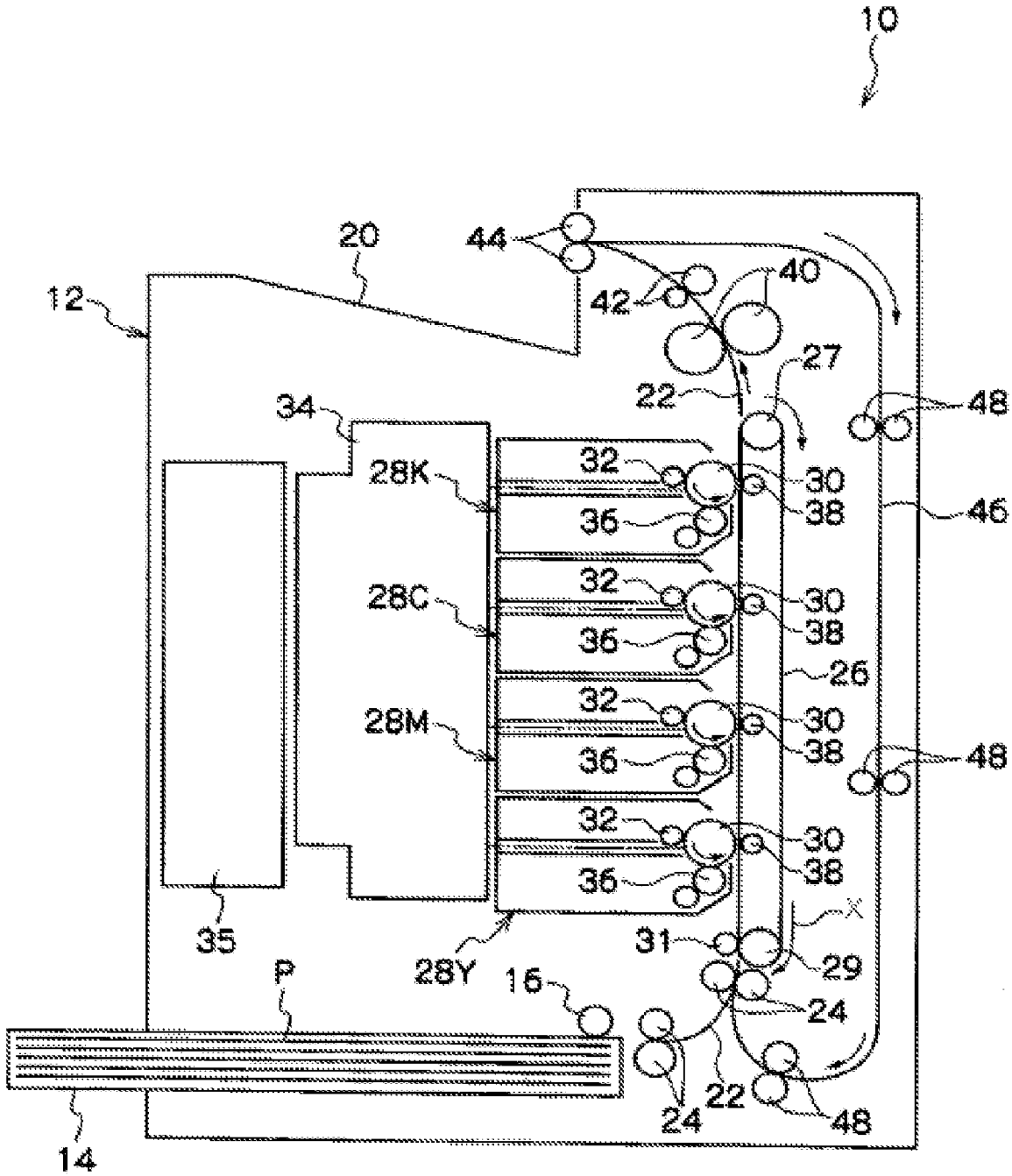
FIG. 1 is a side view of an image formation device relating to an embodiment of the present invention.

As shown in FIG. 1, the image formation device 10 of the present embodiment is provided with a device main body 12. A paper tray 14 is disposed at a lower portion of the device main body 12. The paper tray 14 accommodates paper P (a recording medium) which is stacked in the form of a sheaf.

A feed roller 16 is disposed at an upper portion of a leading end side (the right hand side in FIG. 1) of the paper tray 14. The feed roller 16 presses against the leading end side of an upper face of the paper P and takes out the paper P from inside the paper tray 14.

A first transport path 22 is provided. The first transport path 22 extends from a leading end portion of the paper tray 14, curves gently, and extends substantially vertically upward at a front side of the device (the right side in FIG. 1).

A plurality (for example, two) of transport roller pairs 24 and a transport belt 26, which has an endless form, are arranged along the first transport path 22 in this order from a paper transport direction upstream side. The transport roller pairs 24 nip and convey the paper P. The transport belt 26 electrostatically attracts and attaches thereto and transports paper P on which an image is to be formed. By being disposed along the first transport path 22, the transport belt 26 forms a portion of a path face at one side of the first transport path 22.

The transport belt 26 spans between a spanning roller 27 which is disposed upward and a spanning roller 29 which is disposed downward. One of the spanning roller 27 and the spanning roller 29 is driven to rotate, as a result of which the transport belt 26 turns in direction X.

At a paper transport direction upstream side of the transport belt 26, a charging roller 31 is provided adjacent to the transport belt 26. The charging roller 31 electrostatically charges a surface of the transport belt 26, and presses the paper P that is to be electrostatically adhered and attached to the transport belt 26 against the transport belt 26.

A plurality of process cartridges 28Y, 28M, 28C and 28K are arranged in tandem along the first transport path 22 in a substantially vertical direction in the device main body 12. The process cartridges 28Y, 28M, 28C and 28K oppose the transport belt 26 in a lateral direction to sandwich the first transport path 22 therebetween, and correspond to the respective colors yellow, magenta, cyan and black.

Each of the process cartridges 28Y, 28M, 28C and 28K functions as a processing section relating to an image creation process and is provided with a respective photosensitive drum 30, which rotates in a predetermined direction (anti-clockwise in FIG. 1).

Around each photosensitive drum 30, a charging roller 32 and a developing roller 36 are provided in this order from an upstream side of the direction of rotation of the photosensitive drum 30 (which is an image-bearing body). The charging roller 32 electrostatically charges a surface of the photosensitive drum 30. The developing roller 36 adheres toner of the respective color to a latent image formed on the photosensitive drum 30, to develop the latent image.

An exposure apparatus or toner cartridge 34 exposes the photosensitive drums 30 to form the latent images on the photosensitive drums 30. A power supply 35 (see FIG. 2) is provided adjacent to the exposure apparatus 34 at a rear face side of the exposure apparatus 34 (i.e., the left side in FIG. 1). The power supply 35 supplies electrical power to the exposure apparatus 34.

Meanwhile, transfer devices 38 are provided at an inner periphery side of the transport belt 26. The transfer devices 38 oppose the respective photosensitive drums 30 in the lateral direction and transfer the toner images formed on the photosensitive drums 30 in the lateral direction onto the paper P at predetermined transfer positions.

A fixing apparatus 40, a transport roller pair 42 and an ejection roller pair 44 are disposed at a paper transport direction downstream side relative to the transport belt 26. The fixing apparatus 40 fixes the transferred toner images to the paper P. The transport roller pair 42 nips and transports the paper P. The ejection roller pair 44 ejects the paper P to a catch tray 20.

A second transport path 46 is provided for inverting paper P at one face of which an image has been formed and feeding the paper P back to the first transport path 22 again. The second transport path 46 opposes the first transport path 22 with the transport belt 26 sandwiched therebetween.

A plurality (for example, three) of transport roller pairs 48 are provided at the second transport path 46. The transport roller pairs 48 nip and transport the paper P downward. When images are to be formed at both faces, the paper P that has had an image formed on one face thereof is switchbacked by the ejection roller pair 44 and guided to the second transport path 46, is transported downward by the plurality of transport roller pairs 48, and is fed back to the first transport path 22.

Next, image formation operations of the present embodiment, for forming images on the paper P, will be described.

In the image formation device 10 of the present embodiment, when an image is to be formed on one face of the paper P, the paper P is taken out from the paper tray 14, is transported upward along the first transport path 22 by the plurality of transport roller pairs 24, and is fed to the transport belt 26. The paper P that has been fed to the transport belt 26 is pressed against the transport belt 26 by the charging roller 31 and electrostatically attracted and attached to the charged transport belt 26. This paper P is transported upward and fed to the predetermined transfer positions corresponding to the colors yellow, magenta, cyan and black, in that order.

The paper P that has been fed to a predetermined transfer position has the toner image of the respective color, which has been formed on the photosensitive drum 30, transferred thereto by the transfer device 38. Thus, a full-color image is formed. The paper P is further transported to the fixing apparatus 40, the transferred toner image is fixed by the fixing apparatus 40, and the paper P is ejected to the catch tray 20 by the ejection roller pair 44.

In a case in which images are to be formed on both faces of the paper P, after a toner image has been fixed by the fixing apparatus 40 to form an image at one face, the paper P which has had the image formed at one face is switchbacked by the ejection roller pair 44, and is reversed and fed into the second transport path 46. The paper P is fed from the second transport path 46 into the first transport path 22 again, and an image is formed at the other face side in the same manner as described above. Thus, images are formed at both sides of the paper P. As described above, the image formation operation is performed in a single pass.

Next, a frame at which the process cartridges 28Y, 28M, 28C and 28K and the exposure apparatus 34 are installed will be described.

Figure 2:
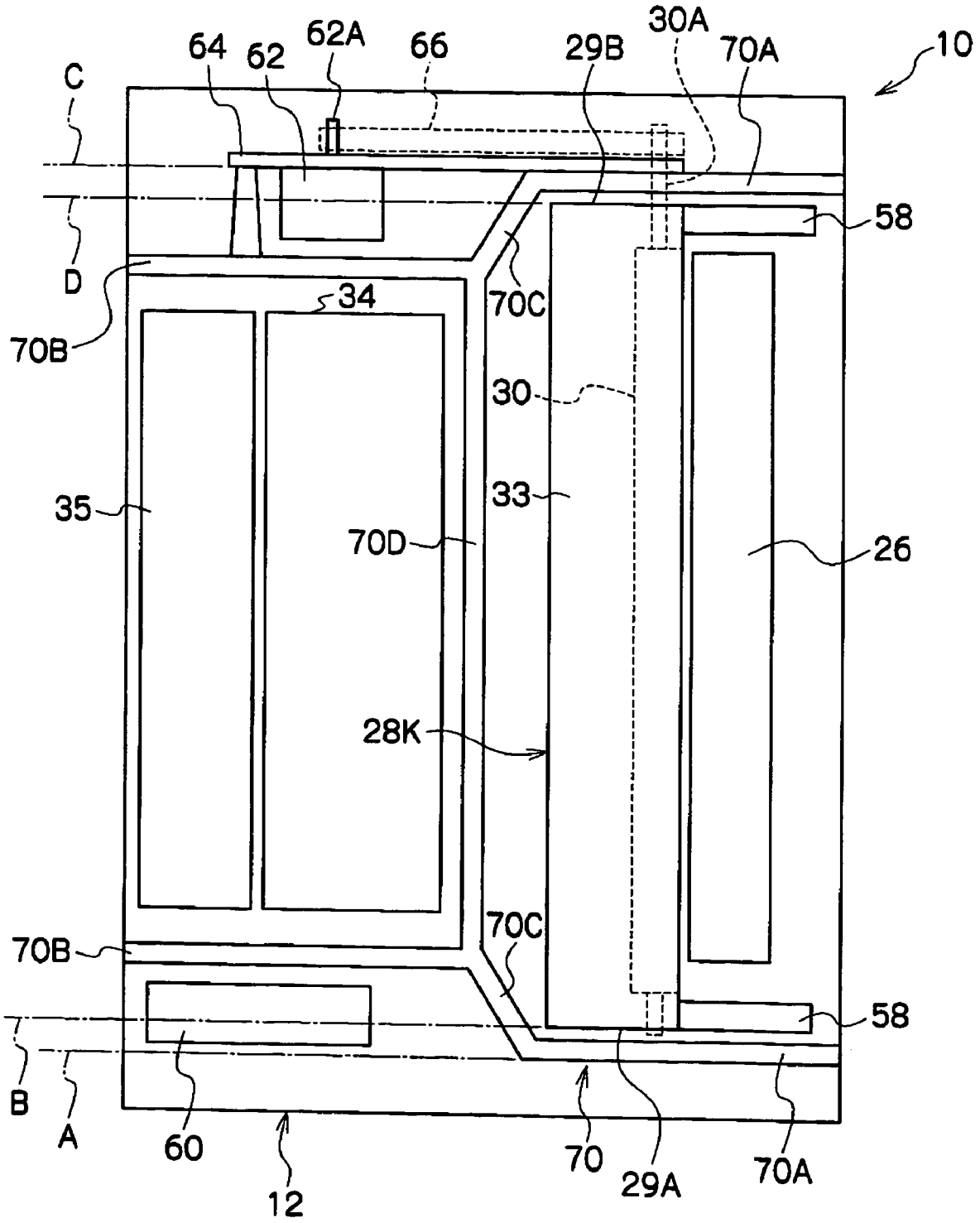
FIG. 2 is a plan view of the image formation device relating to the present embodiment.

A frame 70 is provided at the device main body 12. As shown in FIG. 2, when viewed from above, the frame 70 has an approximate 'H' shape. The frame 70 is provided with a facing pair of first side plates 70A. A spacing between the first side plates 70A is set to a spacing which is substantially equal to a length from a side face 29A to a side face 29B of a casing 33, in which the process cartridges 28Y, 28M, 28C and 28K are installed.

The frame 70 is also provided with a pair of second side plates 70B, which are arranged with a spacing therebetween which is narrower than the spacing between the first side plates 70A.

The spacing between the second side plates 70B is set to be shorter than the length from the side face 29A to the side face 29B of the casing 33 of the process cartridges 28Y, 28M, 28C and 28K, and shorter than an axial direction length of the photosensitive drums 30 provided at the process cartridges 28Y, 28M, 28C and 28K.

The first side plates 70A are joined with the respective second side plates 70B by joining plates 70C. At joining portions at which the first side plates 70A and joining plates 70C are joined and at joining portions at which the second side plates 70B and joining plates 70C are joined, the frame 70 is inflected. The two first side plates 70A are joined together by a partition plate 70D, which is provided at a central portion of the frame 70.

Figure 3:
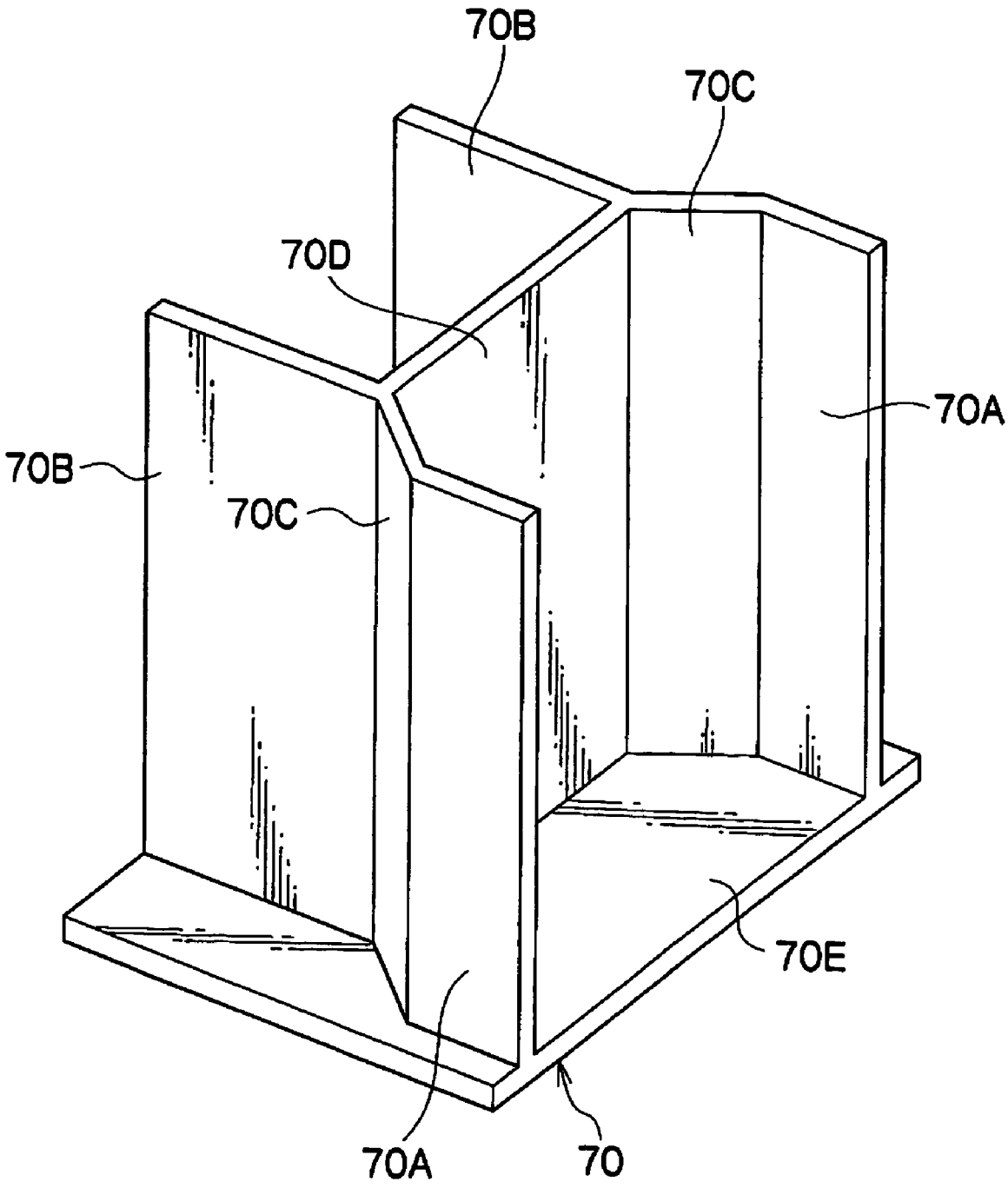
FIG. 3 is a perspective view showing a frame relating to the present embodiment.

As shown in FIG. 3, these first side plates 70A, second side plates 70B, joining plates 70C and partition plate 70D are provided standing in a substantially perpendicular direction from a baseplate 70E. The first side plates 70A, second side plates 70B, joining plates 70C, partition plate 70D and baseplate 70E are formed integrally. The first side plates 70A, second side plates 70B, joining plates 70C, partition plate 70D and baseplate 70E are formed of a plastic material.

The partition plate 70D divides a region at which the process cartridges 28Y, 28M, 28C and 28K and the transport belt 26 are accommodated from a region at which the exposure apparatus 34 and the power supply 35 of the exposure apparatus 34 are accommodated. The partition plate 70D also serves to enhance rigidity of the first side plates 70A by joining together the two first side plates 70A.

Here, slits (not shown) are formed in the partition plate 70D. Exposure beams which are irradiated from the exposure apparatus 34 towards the photosensitive drums 30 pass through the slits.

Between the pair of first side plates 70A, the process cartridges 28Y, 28M, 28C and 28K are installed such that a length direction of arrangement of the process cartridges 28Y, 28M, 28C and 28K is orthogonal with respect to the first side plates 70A. A pair of grips 58 are provided at two length direction end portions of the process cartridges 28Y, 28M, 28C and 28K. The transport belt 26 is disposed so as to be located between the pair of grips 58.

Meanwhile, the exposure apparatus 34 and the power supply 35 of the exposure apparatus 34 are installed between the second side plates 70B.

A circuit board 60, which is an electrical component, is disposed at an outer side of one of the second side plates 70B (the one at the lower side in FIG. 2). Electronic components which implement control of driving of image formation operations are assembled to the circuit board 60.

The circuit board 60 is disposed at a position which is at an inward side relative to a position of an outer face of a corresponding one of the first side plates 70A (i.e., the one at the lower side in FIG. 2). In other words, the circuit board 60 is disposed at an inward side relative to a line extended along from the outer face of the first side plate 70A (i.e., the dashed line A).

Further, the circuit board 60 is disposed so as to at least partially fall within a projected area of the process cartridges 28Y, 28M, 28C and 28K. That is, at least a portion of the circuit board 60 is disposed at the inward side relative to a line extended along from the side face 29A of the process cartridges 28Y, 28M, 28C and 28K (i.e., the dashed line B).

A driving motor 62, which is an electrical component, is disposed at an outer side of the other of the second side plates 70B (i.e., the one at the upper side in FIG. 2). The driving motor 62 is for driving to turn the photosensitive drums 30 provided at the process cartridges 28Y, 28M, 28C and 28K.

The driving motor 62 is supported at a mounting plate 64, which is fixed to the first side plate 70A and the second side plate 70B. A driving shaft 62A of the driving motor 62 is coupled with rotation shafts 30A of the photosensitive drums 30 by a coupling portion 66. Driving force of the driving motor 62 is transmitted to the rotation shafts 30A of the photosensitive drums 30, to rotate the photosensitive drums 30.

The driving motor 62 is disposed at a position which is at an inward side relative to a position of an outer face of the other first side plate 70A (i.e., the first side plate 70A at the upper side in FIG. 2). In other words, the driving motor 62 is disposed at an inward side relative to a line extended along from the outer face of the first side plate 70A (i.e., the dashed line C).

Further, the driving motor 62 is disposed so as to at least partially fall within a projected area of the process cartridges 28Y, 28M, 28C and 28K. That is, at least a portion of the driving motor 62 is disposed at the inward side relative to a line extended along from the side face 29B of the process cartridges 28Y, 28M, 28C and 28K (i.e., the broken line D).

Next, operation of the embodiment described above will be described.

In the present embodiment, the spacing between the pair of second side plates 70B, at which the exposure device is to be installed, is made smaller than the spacing between the pair of first side plates 70A, at which the process cartridges 28Y, 28M, 28C and 28K are to be installed, and the circuit board 60 and driving motor 62, which serve as electrical components, are disposed at the outer sides of the second side plates 70B.

It is not possible to make an axial direction length of the photosensitive drums 30 smaller than a width of the paper P at which images are to be formed. Thus, there is a limitation on reductions in width of the process cartridges 28Y, 28M, 28C and 28K at which the photosensitive drums 30 are provided. Hence, there is a limitation on narrowing of the spacing of the first side plates 70A at which the process cartridges 28Y, 28M, 28C and 28K are to be installed.

On the other hand, unlike the photosensitive drums 30, the exposure apparatus 34 which is to be installed between the pair of second side plates 70B is not necessarily dependent on the width of the paper P at which images are to be formed, and it is possible to reduce a width of this apparatus.

Accordingly, in the present embodiment, the spacing of the second side plates 70B at which the exposure apparatus 34 is to be installed is made narrower than the spacing of the first side plates 70A, and the circuit board 60 and driving motor 62 are disposed at the outer sides of the second side plates 70B.

Therefore, even when the circuit board 60 and driving motor 62 are disposed at the outer sides of the side plates, it is possible to reduce width of the overall device, and a reduction in size of the device can be achieved.

Furthermore, because the electrical components such as the circuit board 60 and the driving motor 62 or the like are disposed at the outer sides of the side plates, wiring is facilitated, assembly during construction is easier, and maintenance, replacement and the like subsequent to assembly are easier.

Further again, in the present embodiment, the spacing of the first side plates 70A is set to a spacing substantially equal to the length of the casing of the process cartridges 28Y, 28M, 28C and 28K, the spacing of the second side plates 70B is made shorter than the length of the casing of the process cartridges 28Y, 28M, 28C and 28K, and the spacing of the second side plates 70B is also made shorter than the axial direction length of the photosensitive drums 30 provided at the process cartridges 28Y, 28M, 28C and 28K. Consequently, dead space is eliminated, the width of the overall device can be made as small as is possible, and a reduction in size of the device can be achieved.

Because the frame 70 is formed of a plastic material, strength thereof will not be adversely affected even though the first side plates 70A and second side plates 70B are provided with different spacings, and the frame 70 can be formed at low cost.

Further yet, at the joining portions which link the first side plates 70A with the second side plates 70B, the joining plates 70C constitute inflected joining portions which are inflected relative to the first side plates 70A and the second side plates 70B. Therefore, torsional rigidities of the first side plates 70A and second side plates 70B are high.

Figure 4:
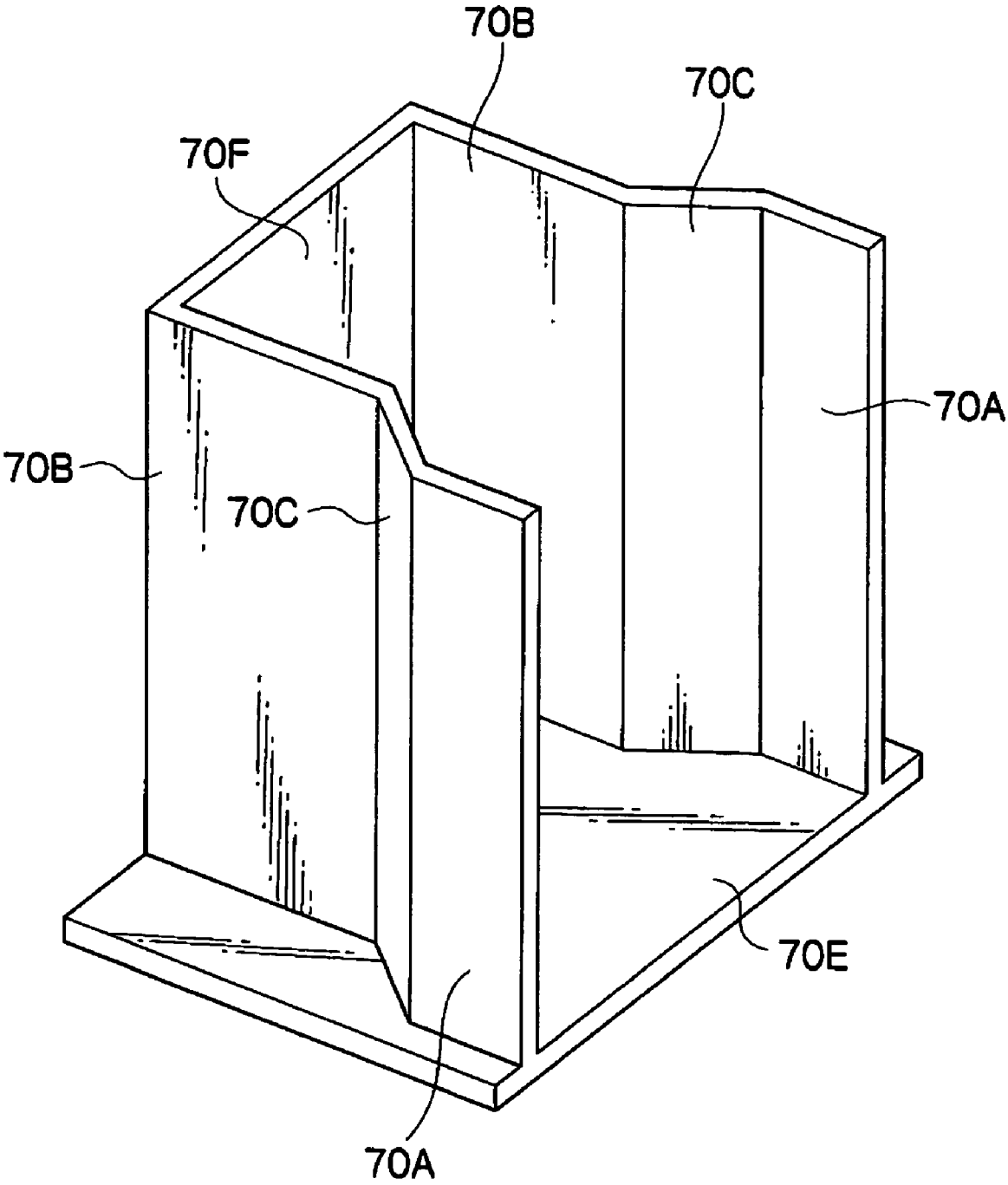
FIG. 4 is a perspective view showing a variant example of the frame relating to the present embodiment.

Now, in the embodiment described above, the frame 70 has the form of an approximate 'H' shape as viewed from above. However, the form of a frame according to the present invention is not limited thus. For example, as shown in FIG. 4, a back face plate 70F, which joins rear face ends of the second side plates 70B, may be provided instead of the partition plate 70D, for a form with a substantial 'U' shape which opens at the forward end of the first side plates 70A. That is, it is sufficient that a frame is provided with a pair of the first side plates 70A and with a pair of the second side plates 70B with a spacing narrower than the spacing of the first side plates 70A.

Further, in the embodiment described above, the pair of first side plates 70A and the pair of second side plates 70B are provided as an integrally formed frame. However, the first side plates 70A and the second side plates 70B of the present invention may be structured as respectively separate frames.

Further again, in the embodiment described above, the frame 70 is formed by resin-molding. However, formation by resin-molding is not necessarily required. A frame of the present invention could, for example, be fabricated of metal, or only a portion of the frame could be formed by resin-molding.

Further still, in the embodiment described above, the circuit board 60 and the driving motor 62 are offered as examples of electrical components. However, electrical components for the present invention are not limited thus. Examples include: a sensor employed for image formation processing; a harness for distributing wiring to a power source, a circuit board or the like; an interface section for connecting to and exchanging signals with other equipment; a driving motor for driving other structural components; a power source for providing electrical power to such a driving motor; and so forth.

Further yet, the embodiment described above has the structure which is provided with the plurality of process cartridges 28Y, 28M, 28C and 28K, for forming full-color images. However, a structure of the present invention could be a structure which is provided with just one process cartridge, for forming single-color images.

Further still again, an example in which the exposure apparatus 34 is disposed between the second side plates 70B has been described. However, the exposure apparatus 34 could be substituted with toner cartridges which accommodate toner to be supplied to process cartridges. As explained above, reference character 34 alternatively refers to a toner cartridge. Such a case would obviously be an image formation device of a form that includes toner cartridges separately from the process cartridges. The present invention could also be applied to an image formation device with a form in which, instead of the process cartridges, the photosensitive drums 30 and the like are fixed to the device main body.

While the present invention has been described and illustrated with respect to some specific embodiments thereof, it is to be understood that the present invention is by no means limited thereto and encompasses all changes and modifications which will become possible without departing from the scope and spirit of the present invention.

What is claimed is:

1. An image formation device comprising:

a pair of first side plates provided at a device main body, between which a process cartridge is installed;

a pair of second side plates, between which another apparatus to be disposed at the device main body is installed, the second side plates being disposed with a narrower spacing therebetween than the first side plates; and an electrical component, which is disposed at an outer side of the second side plates wherein the first side plates and second side plates are joined by inflected joining portions each having an angle other than 90 degrees.

2. The image formation device of claim 1, wherein the another apparatus to be disposed at the device main body comprises at least one of an exposure apparatus, for exposing a photosensitive body provided at the process cartridge, and a toner cartridge, for accommodating toner to be supplied to the process cartridge.

3. The image formation device of claim 2, wherein the electrical component is disposed such that at least a portion thereof falls within a projected area of the process cartridge.

4. The image formation device of claim 1, wherein a spacing between the first side plates is set to a spacing which is substantially equal to a length of a casing of the process cartridge.

5. The image formation device of claim 4, wherein the electrical component is disposed such that at least a portion thereof falls within a projected area of the process cartridge.

6. The image formation device of claim 1, wherein the spacing of the second side plates is set to be shorter than a length of a casing of the process cartridge.

7. The image formation device of claim 6, wherein the electrical component is disposed such that at least a portion thereof falls within a projected area of the process cartridge.

8. The image formation device of claim 1, wherein the spacing of the second side plates is set to be shorter than a length of an image-bearing body provided at the process cartridge.

9. The image formation device of claim 8, wherein the electrical component is disposed such that at least a portion thereof falls within a projected area of the process cartridge.

10. The image formation device of claim 1, wherein the electrical component is disposed such that at least a portion thereof falls within a projected area of the process cartridge.

11. The image formation device of claim 1, wherein the first side plates and second side plates are formed integrally.

12. The image formation device of claim 11, wherein a frame is provided which includes the first side plates and the second side plates.

13. The image formation device of claim 12, wherein the first side plates and second side plates are joined by said inflected joining portions, and the frame is formed substantially in a letter 'U' shape.

14. The image formation device of claim 1, wherein the first side plates and the second side plates are formed of resin.

15. The image formation device of claim 1, wherein the first side plates and the second side plates are partially formed of resin.

16. The image formation device of claim 1, wherein the first side plates and the second side plates are formed of metal.

17. An image formation device comprising:

a pair of first side plates provided at a device main body, between which a process cartridge is installed;

a pair of second side plates, between which another apparatus to be disposed at the device main body is installed, the second side plates being disposed with a narrower spacing therebetween than the first side plates; and an electrical component, which is disposed at an outer side of the second side plates wherein the first side plates and second side plates are joined by inflected joining portions, the first side plates and second side plates are formed integrally, a frame is provided which includes the first side plates and the second side plates, and further, wherein the first side plates and second side plates are joined by said inflected joining portions, and the frame is formed substantially in a letter 'H' shape.

18. The image formation device of claim 17, wherein exposure beams pass through slits in a partition plate that is positioned between each of said pair of first side plates and said second side plates at a central portion of said image formation device.

19. An image formation device comprising:

a frame, which is integrally provided with a pair of first side plates provided at a device main body, between which a process cartridge is installed, and a pair of second side plates, between which another apparatus to be disposed at the device main body is installed, the second side plates being disposed with a narrower spacing therebetween than the first side plates; and an electrical component, which is disposed at an outer side of the second side plates wherein the first side plates and second side plates are joined by inflected joining portions each having an angle other than 90 degrees, and the frame is structured in the form of a substantial letter 'U' shape, and the electrical component is disposed such that at least a portion thereof falls within a projected area of the process cartridge.

20. An image formation device comprising:

a pair of first side plates provided at a device main body, between which a processing section which includes at least a photosensitive body is installed;

a pair of second side plates, between which another apparatus to be disposed at the device main body is installed, the second side plates being disposed with a narrower spacing therebetween than the first side plates;

a partition plate positioned between each of said pair of first side plates and said second side plates at a central portion of said image formation device; and an electrical component, which is disposed at an outer side of the second side plates.

* * * * *